US005338922A

United States Patent [19]

Kim et al.

[11] Patent Number: 5,338,922

[45] Date of Patent: Aug. 16, 1994

[54] TRAY EXTENDING APPARATUSES FOR AN OVEN

[75] Inventors: Young D. Kim; Sung H. Hong, both of Suweon, Rep. of Korea

[73] Assignee: Samsung Electronics Co., Ltd., Suwon, Rep. of Korea

[21] Appl. No.: 17,514

[22] Filed: Feb. 12, 1993

[30] Foreign Application Priority Data

Feb. 17, 1992 [KR] Rep. of Korea ..... 92-2265[U]
Feb. 17, 1992 [KR] Rep. of Korea ..... 92-2266[U]

[51] Int. Cl.[5] ..... H05B 6/80

[52] U.S. Cl. ..... 219/763; 219/756; 219/521; 126/340; 312/236

[58] Field of Search ..... 219/10.55 E, 10.55 F, 219/10.55 D, 10.55 R, 521, 762, 763, 756; 126/340, 339; 312/236, 273

[56] References Cited

U.S. PATENT DOCUMENTS

| | | | |
|---|---|---|---|
| 569,413 | 10/1896 | Heinemann | 126/340 |
| 2,657,110 | 10/1953 | Feder | 126/340 |
| 4,335,292 | 6/1982 | Tanaka et al. | 219/10.55 F |
| 4,940,869 | 7/1990 | Scholtes et al. | 219/10.55 E |
| 5,171,951 | 12/1992 | Chartrain et al. | 219/10.55 E |
| 5,216,216 | 6/1993 | Kim | 219/10.55 E |

FOREIGN PATENT DOCUMENTS

| | | |
|---|---|---|
| 64-19819 | 1/1989 | Japan . |
| 1-97116 | 6/1989 | Japan . |

*Primary Examiner*—Philip H. Leung
*Attorney, Agent, or Firm*—Burns, Doane, Swecker & Mathis

[57] ABSTRACT

A microwave oven includes a cooking chamber having a door. A tray is mounted in the chamber by a roller/-guide track arrangement such that gravitational force acting on the tray is converted into a force which slides the tray forwardly when the door is opened.

6 Claims, 5 Drawing Sheets

TRAY EXTENDING APPARATUSES FOR AN OVEN

TECHNICAL FIELD

This invention relates to a microwave oven and, more particularly, to a tray extending apparatus for a microwave oven which moves the tray located in the cooking chamber in a forward/reverse direction in response to the opening and closing of the oven.

BACKGROUND ART

A cooker described in Japanese Utility Model No. 1-97116 (1989) comprises a heater, a door installed at the front of the main body, and a tray retracted or extended by the interaction of a number of linkrods in the cooking chamber.

Also, a cooker described in Japanese Utility Model No. 64-19819(1989) comprises a grill for placing foodstuffs thereon, an initial member extending the grill from the cooking chamber responsive to the opening of the door, a tray arranged under the grill, and a second member extending the tray from the cooking chamber responsive to with the opening of the door.

In the above-mentioned prior art, the food tray is extended from the cooking chamber responsive to the opening of the door by connecting the tray either with linkrods, or with the initial and second members.

But, the constructions of the prior art are in general very complicated because the prior art has a number of linked members and so a number of pins or hinges are required between the members and also these members must be mutually interconnected to respond to relative movements of the door.

Further, when the ovens are used for a long period, the inconvenience attendant upon their maintenance and repairs results because the parts for connecting the linkrods with each other, such as a pin and a hinge, are easily damaged.

In addition, they have the disadvantage that the space occupied by the linked members is so relatively large that the cooking space in the cooking chamber is reduced.

SUMMARY OF THE PRESENT INVENTION

It is an object of the present invention to provide a tray extending apparatus with a simple and reliable construction and operation.

It is another object of the present invention to provide a tray extending apparatus which automatically extends the tray from the cooking chamber by means of gravity causing a plurality of rollers to move when the door is opened.

It is still another object of the present invention to provide a tray extending apparatus which can control the extension speed of the tray by the sliding contact between a projection formed at the inner lower portion of the door and the curved edge formed at the corresponding side of the food tray.

The tray extending apparatus according to this invention comprises a door, a tray for placing foodstuffs thereon, a plurality of rollers and guide rails which move the tray in the forward/reverse direction in response to the opening and closing of the door, and a projection provided on the inner lower portion of the door on the door hinge side.

This invention can be divided into two preferred embodiments concerning to the means to form and arrange a plurality of rollers and guide rails: one embodiment wherein a plurality of rollers and guide rails are installed on the back of the tray and on the floor of the cooking chamber respectively so that the tray is moved due to the interaction of one to the other, and the other embodiment wherein a plurality of rollers and guide rails are installed on the lower portion of both side walls of the cooking chamber and on both side edges of the tray respectively, so that the tray is moved due to the interaction of one to the other.

Each preferred embodiment will be described below.

In the first embodiment, two pairs of guide rails are installed on the floor of the cooking chamber, one pair towards the front side and one pair towards the rear.

Each guide rail is shaped in the form of an elongated triangle so that it's center line is parallel to the side wall of the cooking chamber and the space between the two rails of the triangular guide rail narrows gradually towards the rear of the cooking chamber.

Stoppers are provided at both the ends of each set of guide rails in order to prevent the rollers from moving off the guide rails.

One pair of rollers moving on the guide rails is installed on each side at the rear of the tray, and the other pair is installed on each side at the front of the tray.

The rollers are designed in the shape of a double cone, but spherical shaped rollers are also possible for this purpose.

The front-half of the quadrilateral tray is of uniform thickness, but the rear-half portion of the tray gradually becomes thicker towards the rear side.

A member for preventing the tilting of the tray(to be described as a 'tilt prevention member' hereinafter) is located at the center of both of the side walls of the cooking chamber and is installed at a slightly higher position than the height of the rear end of the tray so that the rear end of the tray is not raised by the weight of both the tray and foodstuffs when the tray is extended from the cooking chamber.

The projection, the front surface of which is rounded, is installed at the lower portion on the inside of the hinge side of the door and retracts the tray into the cooking chamber in response to the closing of the door due to the interaction with the corresponding curved surface of the tray.

That is, when the door is opened, the tray is smoothly extended from the cooking chamber along the guide rails and when the door is closed, the tray is smoothly retracted into the cooking chamber, by means of the projection moving along the curved surface of the front corner of the tray.

The two pairs of guide rails described above are shaped so that the space between the two rails of each guide rail gets narrower gradually toward the inside of the cooking chamber in order to automatically extend the tray.

Accordingly, when the door is closed, a plurality of rollers rotate on the guide rails and finally move to the end of each rail where the space between the two rails is the narrowest. Therefore, the contact point where a roller meet a guide rail, which creates a resisting force against gravity, is moved slightly backwards from the centers of the rollers due to the shape of each rail described above so that it creates a turning movement for the rollers, and therefore the tray is automatically extended from the cooking chamber along the guide rails when the door is opened.

Another embodiment which is similar to the first embodiment explained above except several parts will be described in detail below.

In the first embodiment, the tray is moved in a forward direction due to the interaction of a plurality of rollers and guide rails one to the other, installed both on the back of the tray and also on the floor of the cooking chamber.

On the other hand, in the second embodiment which will be described below, a plurality of rollers and guide rails are installed on both side walls of the cooking chamber and on both side edges of the tray respectively, and the tray is moved due to the interaction of one to the other.

A pair of rollers placed at the rear portion of the cooking chamber are installed slightly higher than the other pair of rollers placed toward the front so that the tray mounted on the rollers slopes gently down toward the front of the microwave oven.

Accordingly, when the door is opened, the tray is automatically extended by the rotation of the rollers created by gravity.

In the first embodiment, the speed of extension/retraction of the tray is controlled by the interaction of the curved surface formed at the side of the tray and the projection, the front surface of which is rounded, which is installed on the lower portion of the inner hinge side of the door.

But, a tilt prevention member which prevents the tray from tilting is not necessary because the rollers are installed on both side walls of the cooking chamber.

For assembling and disassembling the tray to/from the rollers, a portion of the bottom side of each guide rail is removed so that the guide rails can be inserted in the rollers through the exposed area.

The tray extending apparatus according to this invention offers the advantages that it has a simple movement and thus seldom malfunctions, and therefore its maintenance is very easy because the apparatus has no complicated/interconnected moving members as required by the prior art, and the extension or retraction of the tray is achieved with merely a plurality of rollers and guide rails.

In addition, it has another advantage in that the space for cooking in the cooking chamber is relatively large compared with the ovens designed according to the prior art described above.

BRIEF DESCRIPTION OF THE DRAWINGS

Embodiments of the invention will now be described by way of example and with reference to the accompanying drawings, in which:

FIG. 1 is a perspective view of a microwave oven showing the condition wherein the tray is extended from the cooking chamber with the opening of a door;

FIG. 2 is a horizontal sectional view of a microwave oven showing (in dotted line) a plurality of rollers and guide rails placed under a tray with the door closed;

FIG. 3 is a view of a microwave oven similar to FIG. 2 showing the condition wherein the tray is extended from the cooking chamber along the guide rails due to the interaction of a projection provided at the lower inner portion of the door and a curved surface formed at the corresponding side of the tray, with the door open;

FIG. 4 is a schematic side view of a microwave oven showing the condition wherein the rollers remain at the inside ends of the guide rails;

FIG. 5 is a schematic side view of a microwave oven showing the condition wherein the tray is extended outside when the door is opened;

FIG. 6 is a fragmentary side view showing in schematic form the principle that the turning movement M acts on a roller due to the movement of the contact point where a guide rail meets a roller, from point A to point B;

FIG. 7 is a fragmentary vertical sectional view of a microwave oven showing a guide rail formed at one side edge of a tray according to FIG. 7 and a roller and a bearing member installed on one schematic side wall of a cooking chamber; and FIG. 8 is a side view of a tray showing the condition wherein the guide rail and rollers slope down at an angle.

DETAILED DESCRIPTION OF THE PREFERRED EMBODIMENTS

Figure 1:
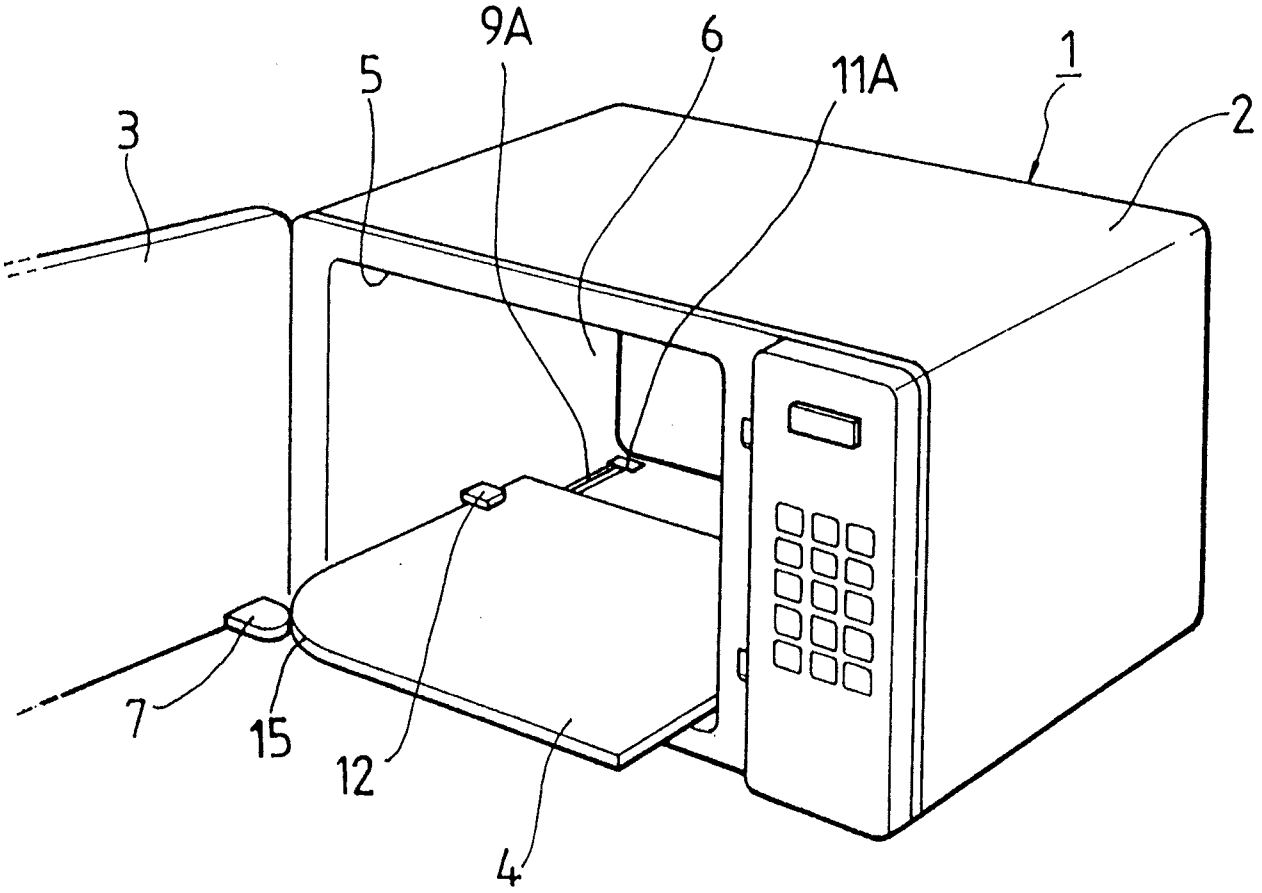
FIGS. 1 to 6 show the first embodiment of this invention.
Figure 2:
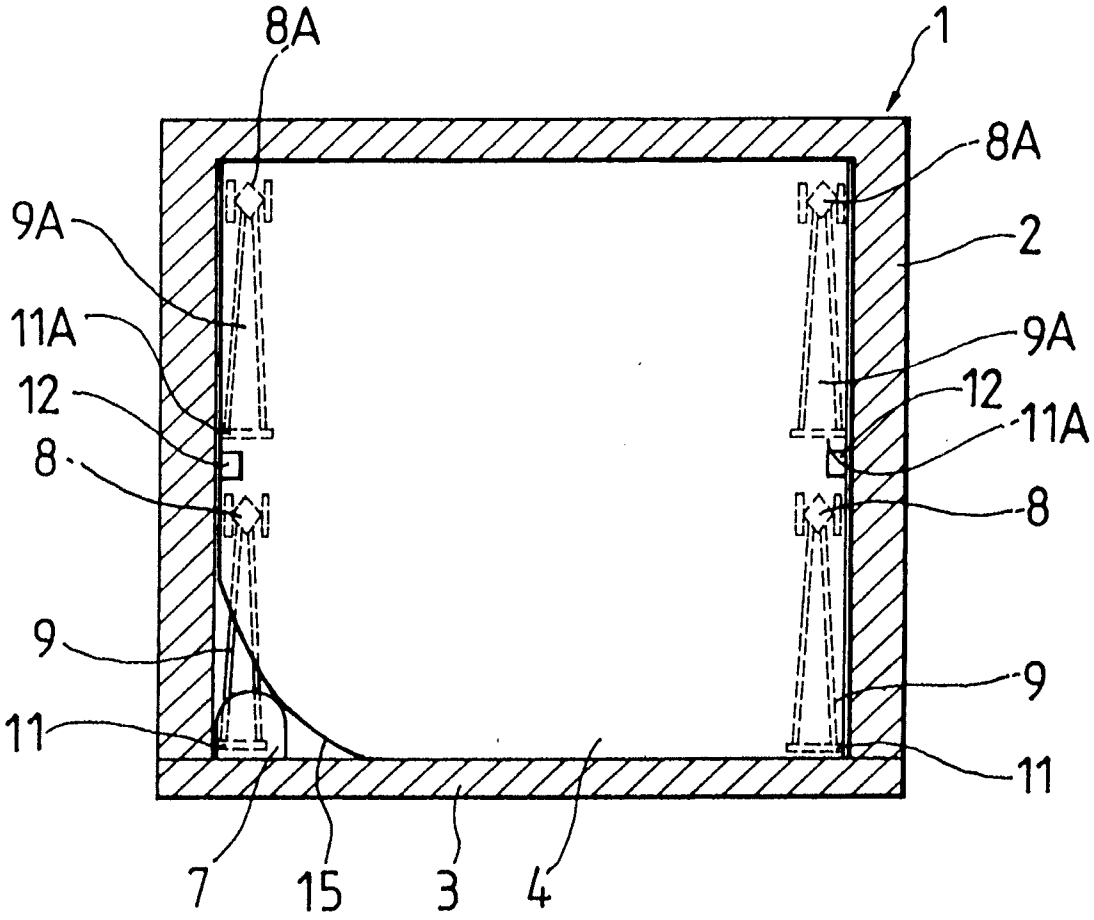
Figure 3:
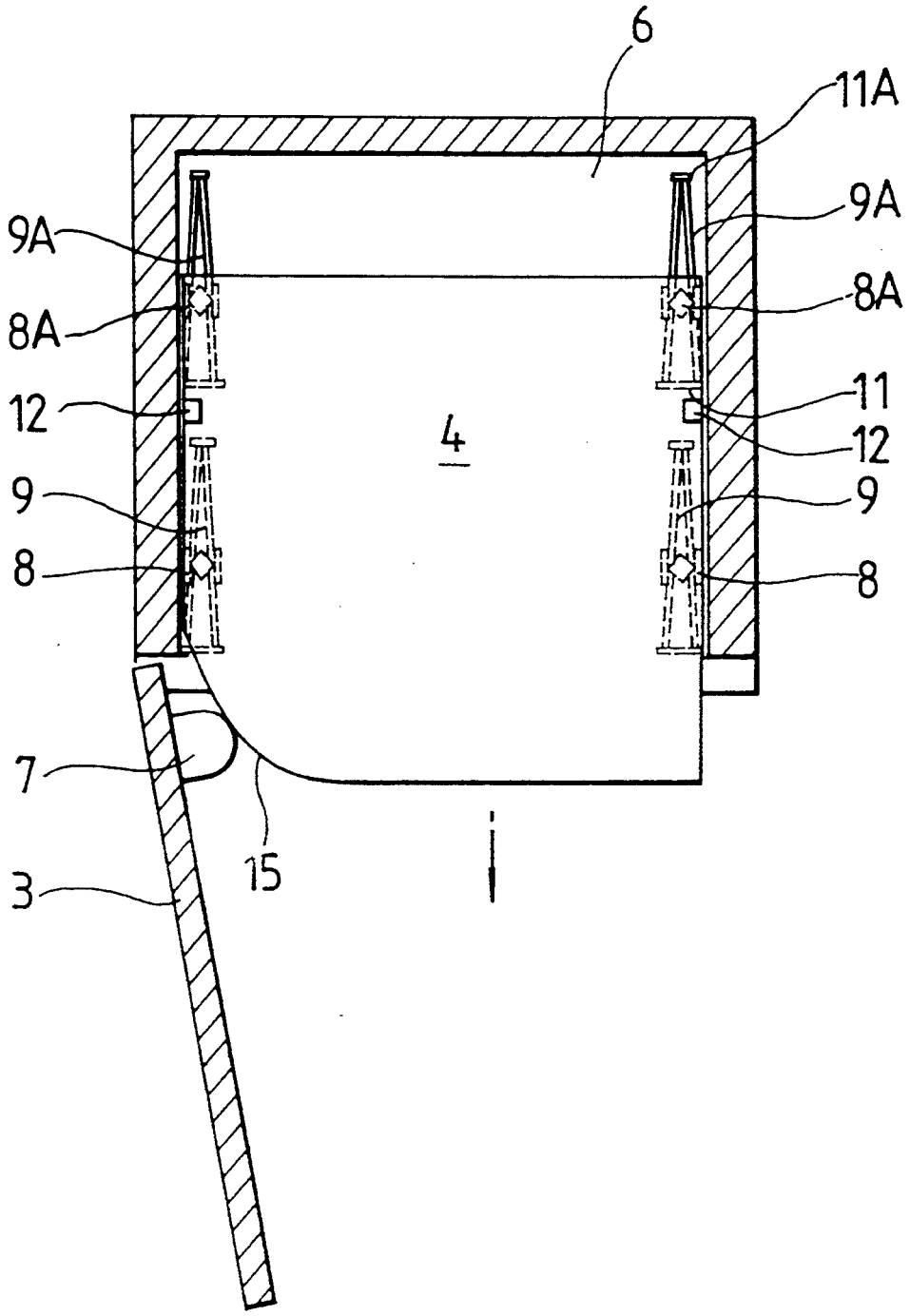

FIGS. 1 to 6 show the first embodiment of this invention.

A tray extending apparatus according to the first embodiment comprises a door 3, comprises a door 3 for opening and closing a front opening of an oven chamber, a tray 4 for receiving foodstuffs, a plurality of rollers 8 and 8A installed on the underside of the tray 4, a plurality of guide rails 9 and 9A installed on the inside bottom surface of the cooking chamber 6, a projection 7 installed on the lower portion of the inner hinge side of the door 3, stoppers il and 11A installed at both ends of the guide rails 9 and 9A, and a tilt prevention member 12 installed on both side walls of the cooking chamber 6.

Figure 4:
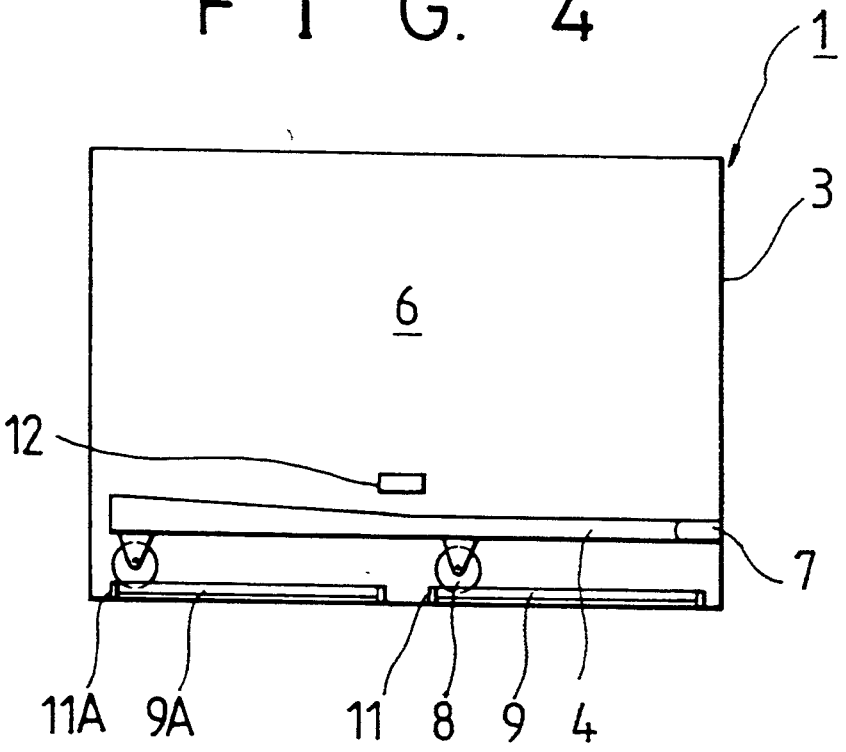

As illustrated in FIG. 4, the rollers 8 and 8A installed on the under side of the tray 4 and moving on the guide rails 9 and 9A are shaped similar to a double cone; that is, the rollers 8 and 8A have a maximum thickness in the center point and its thickness gradually decreases toward the ends of its axis of rotation.

One pair of rollers 8A are provided at the rear of the tray 4 and the other pair of rollers 8 are provided at the center of the tray 4.

In the guide rails 9 and 9A which allow the tray 4 to move in a forward or reverse direction one pair of guide rails 9 extend from the front of the cooking chamber to the center part of the cooking chamber 6, i.e., the rails diverge forwardly on the inner bottom surface, and the other pair of guide rails 9A extend from the center part of the cooking chamber 6 to the interior rear of said chamber.

The stoppers 11 and 11A are installed at both the ends of each guide rail in order to restrict the movement of the two pairs of rollers 8 and 8A to the area between both ends of the guide rails 9 and 9A.

The guide rails 9 and 9A, which form a special feature of this invention, are shaped such that the space between the two rails of each guide rail defines a channel which gets narrower towards the inside rear of the cooking chamber 6.

That is, the space between each two rails forming the first guide rails 9 gets narrower towards the inside rear of the cooking chamber 6 starting from the front end of the cooking chamber 6 and the space between each two rails forming the second guide rails 9A gets narrower towards the inside rear of the cooking chamber 6 starting from the center part of the cooking chamber 6.

The width between the two rails at the wide end of the guide rails is the same as the width of the roller.

As illustrated in FIG. 1, the front surface of the projection 7 is formed approximately in a semi-circular convexly curved shape and is attached to the lower portion of the inner hinge side of the door 3, and a circular arc portion 15 is formed in the corresponding side of the tray 4. The portion 15 constitutes an intersection between a front edge and one of the side edges of the tray, i.e., a side edge located adjacent a vertical hinge axis of the door.

Due to the interaction of the portions 7, 15, when the door 3 is opened, the tray 4 is smoothly extended from the cooking chamber 6 without hitting the door 3, and when the door is closed, the projection 7 pushes the corresponding side of the tray 4 and the tray 4 is smoothly retracted into the cooking chamber 6.

Figure 5:
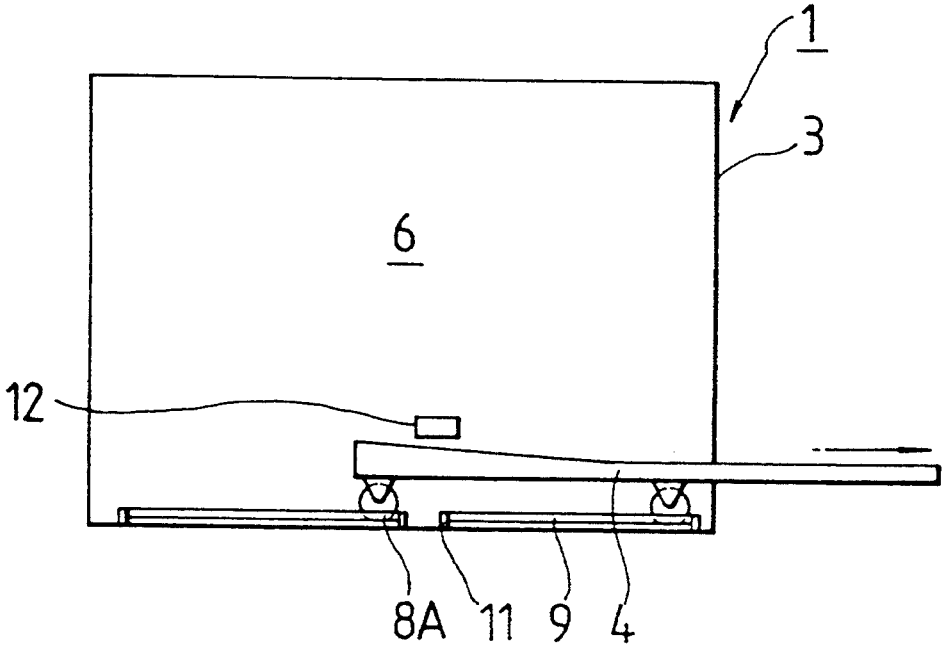

As illustrated in FIG. 4 and FIG. 5, the front-half portion of the tray 4 is flat, and the rear-half portion slopes gently upward toward the rear.

A tilt prevention member 12 for preventing the tray 4 from tilting is provided in the middle of both side walls of the cooking chamber slightly higher than the rear end of the tray 4.

The function of the tilt prevention member 12 is to prevent a pair of rollers 8A in the rear of the tray 4 from being raised out of their tracks caused by weight of the tray 4 and foodstuffs placed thereon when the tray 4 is extended outside with the opening of the door 3.

In the tray extending apparatus described above, the projection 7 moves along the curved surface of the circular arc portion 15 of the tray 4 and thereby applies force to push the tray 4 into the inside of the cooking chamber 6 as the door 3 is closed.

As a result of this force, the two pairs of rollers 8 and 8A installed on the back of the tray 4 are moved on the two pairs of guide rails 9 and 9A on the floor of the cooking chamber 6, and finally the tray 4 is retracted into the cooking chamber 6.

Figure 6:
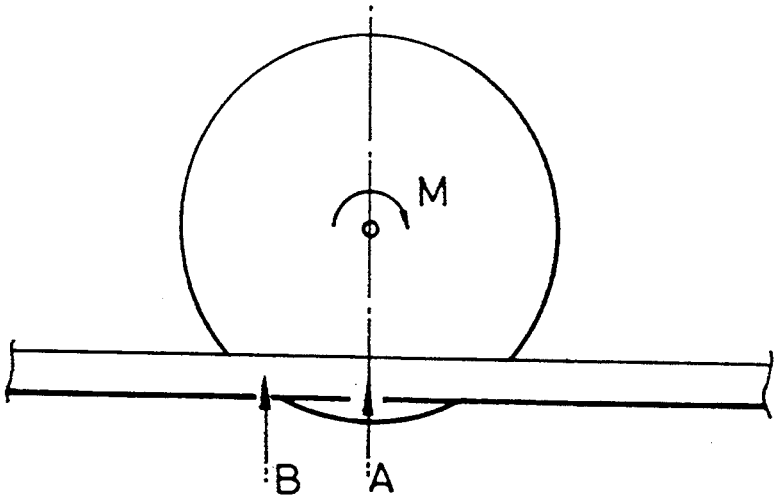

Because the space between the two rails of each guide rail gets narrower gradually toward the inside of the cooking chamber 6 as described above, the place where the roller meets the rails, as illustrated in FIG. 6, is changed from point A to point B when the rollers 8 and 8A are moved to the ends of the guide rails 9 and 9 A.

Accordingly, the resisting force against gravity exerting on each roller, as shown by the arrow at point B, generates the turning movement M for each roller.

Thus, if support by the door 3 is removed with the opening of the door 3, the tray 4 is automatically extended outside due to the turning movement M.

In the tray extending apparatus according to this embodiment, two pairs of rollers 8 and 8A are installed on the back of the tray 4 and are moved on the guide rails 9 and 9A installed on the floor of the cooking chamber 6, but the invention may be performed by a reverse from of construction.

That is, the tray 4 is extended or retracted from/to the cooking chamber 6 by means of the two pairs of rollers 8 and 8A which are affixed to the floor of the cooking chamber 6 and the guide rails 9 and 9A are installed on the underside of the tray 4.

Figure 7:
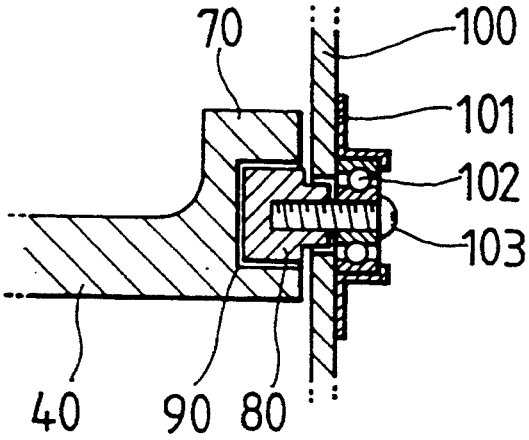
FIGS. 7 and 8 show a second embodiment of this invention.
Figure 8:
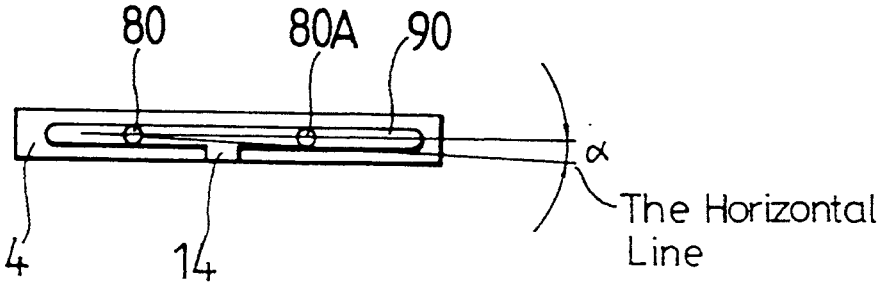

FIGS. 7 and 8 show a second embodiment of this invention.

FIG. 7 illustrates a partial sectional view of one side of the cooking chamber 6, wherein a guide rail 90, different from the first embodiment, is formed at the side edge of the tray 40 and a plurality of rollers 80 and 80A are installed on the side wall 100 of the cooking chamber 6. Each guide rail 90 forms a horizontally outwardly open slot in which the rollers 80, 80A are disposed.

Not being illustrated in the figures, the opposite sides of the tray 40 and the cooking chamber 6 have the same form as shown in FIGS. 7 and 8.

As illustrated in FIG. 8, a pair of rollers 80A placed at the rear of the cooking chamber 6 are installed slightly higher than a pair of rollers 80 placed at the front of the chamber.

Accordingly, the tray 40 held by the rollers 80 and 80A and moved in the forward/reverse direction thereon, is inserted somewhat loosely in the rollers 80 and 80A, its front being tilted downward at a slight angle.

Here, it is preferred that the angle of inclination between the front rollers 80 and the rear rollers 80A is between 3 to 10 degrees.

Also, in order to insert/separate the tray 40 into/from the rollers 80 and 80A, a hole of the same size as each roller is cut into the bottom side of the middle of the guide rail 90, and the second rollers 90A are inserted into the cut portion 14 after the first rollers 90 have been inserted; or the rollers 90 and 90A may be inserted into the tray 40 in the opposite order.

A bearing member 102 is installed at the outside of the side wall 100 of the cooking chamber 6 and is attached by a bracket 101, which holds and freely rotates the rollers 80 and 80A installed at the inside of the side wall 100 of the cooking chamber 6.

Also, the rollers 80 and 80A and the bearing member 102 are joined together by a screw 103 through a penetration hole made in the side wall 100 of the cooking chamber 6.

This is the same as in the first embodiment where the tray 4 is extended or retracted according to the opening or closing of the door 3 by the sliding contact of the projection 7 positioned at the lower portion of the inner hinge side of the door 3, with the circular arc portion 15 formed at the corresponding side of the tray 4.

But, in the second embodiment, the tilt prevention member 12 is not required because the guide rails 90 and 90A(not shown) and the rollers 80 and 80A are installed on the side walls 100 of the cooking chamber 6.

As described above, the tray extending apparatus according to the second embodiment causes the tray 40 to move in the forward direction according to the opening of the door 3 due to the interaction of the rollers 80 and 80A which are tilted somewhat downward toward the front, and the guide rails 90 and 90A(not shown) placed at both side edges of the tray 40.

That is, when the door 3 is opened, the two pairs of rollers 80 and 80A located at different heights from one another are rotated by gravity and thus the tray 40 is automatically extended outside, guided by the projection 7.

In addition, if the door 3 is closed, the tray 40 is pushed back into the inside of the cooking chamber 6 by means of the projection 7 as it moves along the curved surface of the circular arc 15.

Therefore, the speed of extending/retracting the tray 40 from/to the cooking chamber 6 is determined by the user.

What is claimed is:

1. In an oven having a housing forming a cooking chamber having a front opening, and a door connected to a front side of said housing for opening and closing said opening, a food-supporting tray disposed in said chamber, said tray including front and rear edges interconnected by side edges, first and second mounting means disposed adjacent respective side edges of said tray for supporting said tray for forward and rearward movement in said chamber and for converting gravitational force acting on said tray into a force displacing a front portion of said tray forwardly through said opening when said door is open, each of said first and second mounting means comprising roller means carried by one of said tray and housing and disposed in channel means carried by the other of said tray and housing, said roller means being rotatable about a horizontal axis extending transversely of said side edges and being shaped such that a largest cross section of said roller means lies at the axial center thereof, said cross section becoming progressively smaller toward each axial end, said channel means including opposite front and rear ends one of which being horizontally wider than the other, said wider end being shorter than an axial length of said roller means so that said roller means engages horizontally spaced sides of said channel means and so that gravity biases said roller means toward said wider end of said channel means, a front portion of said tray projecting outwardly through said front opening when said roller means is at said wider end, said door including a surface arranged to push said tray rearwardly into said chamber against the bias of gravity when said door is closed.

2. Apparatus according to claim 1, wherein said channel means includes two channels which are aligned with one another in a direction extending perpendicular to said front side of said housing, and said roller means comprises two rollers disposed in respective channels.

3. Apparatus according to claim 1, wherein said channels are disposed on a floor of said chamber, and said rollers are mounted on said tray.

4. Apparatus according to claim 1 further including a tilt-preventing member mounted to said housing and disposed in said chamber above said tray adjacent a respective side edge thereof for preventing a rear portion of said tray from tilting upwardly.

5. Apparatus according to claim 1, wherein an intersection of said front edge and one of said side edges is convexly curved, said door being hinged to rotate about a vertical axis, said surface of said door being convexly curved and located to engage said curved intersection of said tray.

6. In an oven having a housing forming a cooking chamber having a front opening, and a door connected to a front side of said housing for opening and closing said opening, a food-supporting tray disposed in said chamber, said tray including front and rear edges interconnected by side edges, first and second mounting means disposed adjacent respective side edges of said tray for supporting said tray for forward and rearward movement in said chamber and for converting gravitational force acting on said tray into a force displacing a front portion of said tray forwardly through said opening when said door is open, each of said first and second mounting means comprising a horizontally outwardly open slot disposed on a respective side edge of said tray, and front and rear rollers mounted on a side surface of said chamber, said rollers received in said slot, said rear roller being situated at a higher level than said associated front roller such that said tray tends to gravitate forwardly, an intersection of said front edge and one of said side edges of said tray being convexly curved, said door being hinged for rotation about a vertical axis and carrying a projection having a convexly curved edge arranged to engage said convexly curved intersection of said tray to push said tray into said chamber when said door is closed.

* * * * *